US006267621B1

(12) United States Patent
Pitschi et al.

(10) Patent No.: US 6,267,621 B1
(45) Date of Patent: Jul. 31, 2001

(54) CONNECTOR FOR A COAXIAL CABLE WITH ANNULARLY CORRUGATED OUTER CABLE CONDUCTOR

(75) Inventors: Franz Xaver Pitschi, Rottach-Egern; Werner Wild, Buttenwiesen-Unterthürheim; Norbert Strasser, Rosenheim-Oberwöhr, all of (DE)

(73) Assignee: Spinner GmbH Elektrotechnische Fabrik, München (DE)

( * ) Notice: Subject to any disclaimer, the term of this patent is extended or adjusted under 35 U.S.C. 154(b) by 0 days.

(21) Appl. No.: 09/406,994

(22) Filed: Sep. 28, 1999

(30) Foreign Application Priority Data

Oct. 8, 1998 (DE) ..... 198 46 440

(51) Int. Cl.[7] ..... H01R 9/05
(52) U.S. Cl. ..... 439/584; 439/578
(58) Field of Search ..... 439/585, 578–584, 439/775, 429; 29/828, 869

(56) References Cited

U.S. PATENT DOCUMENTS 4,046,451 9/1977 Juds et al. ..... 339/177
6,032,358 * 3/2000 Wild ..... 29/863
6,036,237 * 3/2000 Sweeney ..... 285/322

* cited by examiner

*Primary Examiner*—Gary Paumen
*Assistant Examiner*—Alexander Gilman
(74) *Attorney, Agent, or Firm*—Henry M. Feiereisen; Ursula B. Day

(57) ABSTRACT

A connector for attachment to a coaxial cable having an annular corrugated outer cable conductor, includes a connector head having a threaded portion and defining a ring surface for establishing a contact from inside with an end zone of an outer cable conductor. The outer cable conductor is enclosed by a contact sleeve which has a plurality of radially resilient segments. Surrounding the contact sleeve is a clamping bush which is so threadably engageable with the connector head along a predetermined clamping path, until an end zone of the outer cable conductor, which projects beyond an end face of the contact sleeve, is urged against the contact surface of the connector head. The clamping path of the clamping bush is subdivided in two sections to define an indexing mechanism, with the first section corresponding to a preassembled state of the connector, and with the second section commensurate with a fully assembled connector onto the connecting end of the cable. The indexing mechanism is formed by the interaction between a smooth portion of the clamping bush and by a threaded portion of the connector head, with the threaded portion having a length which is equal or smaller than a length of the smooth portion of the clamping bush.

8 Claims, 6 Drawing Sheets

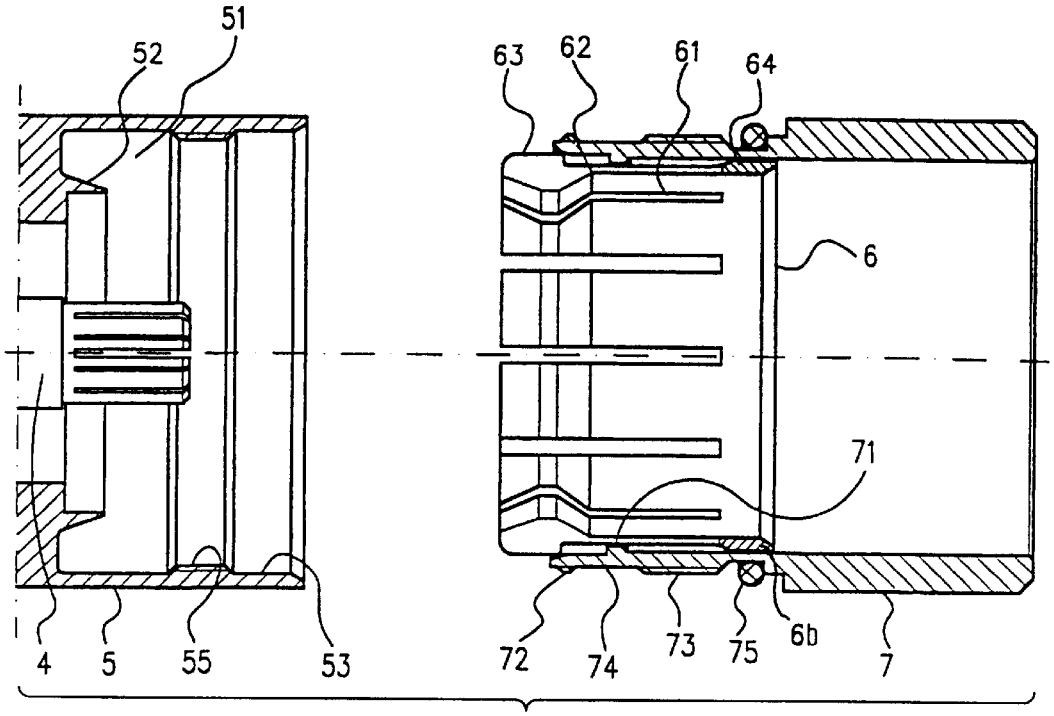
Fig.1
Fig.2
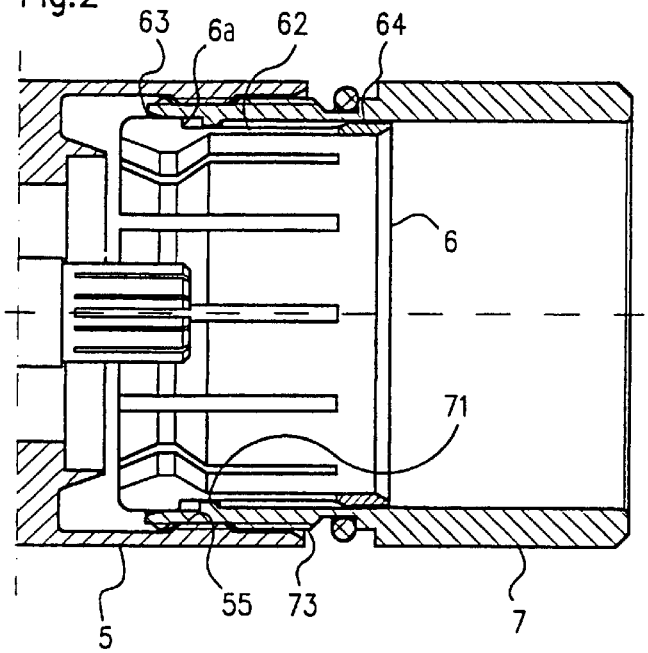

CONNECTOR FOR A COAXIAL CABLE WITH ANNULARLY CORRUGATED OUTER CABLE CONDUCTOR

CROSS-REFERENCES TO RELATED APPLICATIONS

This application claims the priority of German Patent Application, Serial No. 198 46 440.1, filed Oct. 8, 1998, the subject matter of which is incorporated herein by reference.

BACKGROUND OF THE INVENTION

The present invention relates, in general, to a connector for coaxial cables, and more particularly to a connector for coaxial cables of a type having annularly corrugated outer cable conductor.

U.S. Pat. No. 4,046,451, issued on Sep. 6, 1977, describes a connector assembly for a coaxial cable of a type having an annularly corrugated outer cable conductor, with a connector head which is formed with a beveled clamping surface to engage the inner surface of the end zone of the outer cable conductor. Cooperating with the clamping surface of the connector head is a further clamping surface formed on one end of a contact sleeve for engaging the outer surface of the end zone of the outer cable conductor. The contact sleeve is formed at the same time as a hollow screw and has a plurality of slits extending from the connector head proximal end to form a plurality of resilient segments. Each of the segments terminates in a bead for meshing in the first valley of the outer cable conductor and clamping the outer cable conductor against the clamping surface of the connector head along the end zone extending over the contact sleeve, when the connector assembly is mounted to the coaxial cable.

The necessity to dismantle the connector before attachment to the coaxial cable is disadvantageous for several reasons. For one, components may fall out, get lost or mixed up. Moreover, manipulation of several components is time-consuming and annoying, in particular when carrying out the assembly at exposed sites. There is also a risk that errors occur during assembly. A further drawback is the inevitable friction encountered between the beads at the free ends of the segments of the contact sleeve and the outer cable conductor along the outer surface to be contacted and clamped during threaded engagement of the contact sleeve in the connector head. As the outer cable conductor is normally made of a relatively soft copper alloy, the friction frequently results in a squeezing of material in the circumferential direction, leading to respective bending of the segments of the contact sleeve, or as a result of an increase of the torque to be applied for tightening the components in a false indication that a secure clamping and contacting has been attained when in fact that is not the case.

SUMMARY OF THE INVENTION

It is thus an object of the present invention to provide an improved connector, obviating the afore-stated drawbacks.

In particular, it is an object of the present invention to provide an improved connector for coaxial cables having annularly corrugated outer cable conductor, which is easy to make and quick to mount onto the coaxial cable while yet being reliable in operation.

These objects, and others which will become apparent hereinafter, are attained in accordance with the present invention by providing a connector head having a threaded portion and defining a ring surface for establishing a contact from inside with an end zone of an outer cable conductor, a contact sleeve adapted to fit over the outer cable conductor and having a plurality of radially resilient segments, a clamping bush formed with a thread which is interrupted by a smooth portion and adapted to fit over the contact sleeve for threaded engagement with the connector head such as to load, after moving a clamping path, the segments of the contact sleeve in a direction of a clamping action so that the segments clamp the outer cable conductor along the end zone, which projects beyond an end face of the contact sleeve, against the ring surface of the connector head, and an indexing mechanism for subdividing the clamping path of the threaded clamping bush into first and second sections, with the first section corresponding to a preassembled state of the connector, and with the second segment corresponding to a complete assembly of the connector onto the cable end, wherein the indexing mechanism is formed by the smooth portion of the clamping bush and by the threaded portion of the connector head, interacting with one another, with the threaded portion having a length which is equal or smaller than a length of the smooth portion of the clamping bush.

A connector according to the present invention can be installed to one end of the coaxial cable, without preceding dismantling thereof because the novel and inventive design of the pre-assembled connector allows the installer to simply slip the connector over the prepared cable end and to screw the clamping bush to a sufficient extent into the connector head until the threaded portion of the connector head is in engagement with the smooth portion of the clamping bush. This represents a first phase of the clamping path and is commensurate with the correct pre-assembly stage of the clamping bush with respect to the connector head.

The incorporation of the smooth portion of the clamping bush can easily be made in a same work cycle as the cutting of the thread, using a conventional N/C machine.

The connector can be designed of comparably short size when the clamping bush is formed as hollow screw, and the threaded portion of the connector head is an inner thread in a recess of the connector head.

According to another feature of the present invention, the connector head has an axial end for receiving the hollow screw, whereby the connector head may be formed with a ring collar, positioned between the threaded portion and the axial end, for providing a guide when the hollow screw is threaded into the connector head.

Alternatively, the clamping bush may also be designed as a clamping ring which has an inner thread, whereby the threaded portion of the connector head is provided externally.

According to another aspect of the present invention, the connector head may have a smooth portion which complements the smooth portion of the clamping bush. In this case, the thread of the clamping bush includes a first threaded portion, with the smooth portion of the connector head being positioned axially inwardly of the threaded portion of the connector head and defined by a length which at least corresponds to the length of the first threaded portion of the clamping bush. A further threaded portion of the connector head is then positioned axially inwardly of the smooth portion.

In order to ensure a sufficiently stable guidance of the clamping bush in the connector head in the pre-assembly stage of the connector, the smooth portion of the clamping bush, and, if provided, the smooth portion of the connector head may each be formed by a recess in the thread, which recess only slight exceeds the depth of the thread.

The number of revolutions of the clamping bush until clamping the outer cable conductor can be decreased by configuring the engaging threads of connector head and clamping bush as multiple threads.

BRIEF DESCRIPTION OF THE DRAWING

The above and other objects, features and advantages of the present invention will now be described in more detail with reference to the accompanying drawing, in which:

FIG. 1 is a partially exploded sectional view of a first embodiment of a connector according to the present invention, showing individual components of the connector before pre-assembly;

FIG. 2 is a sectional view of the connector of FIG. 1 in the pre-assembled stage;

DETAILED DESCRIPTION OF PREFERRED EMBODIMENTS

Figure 3:
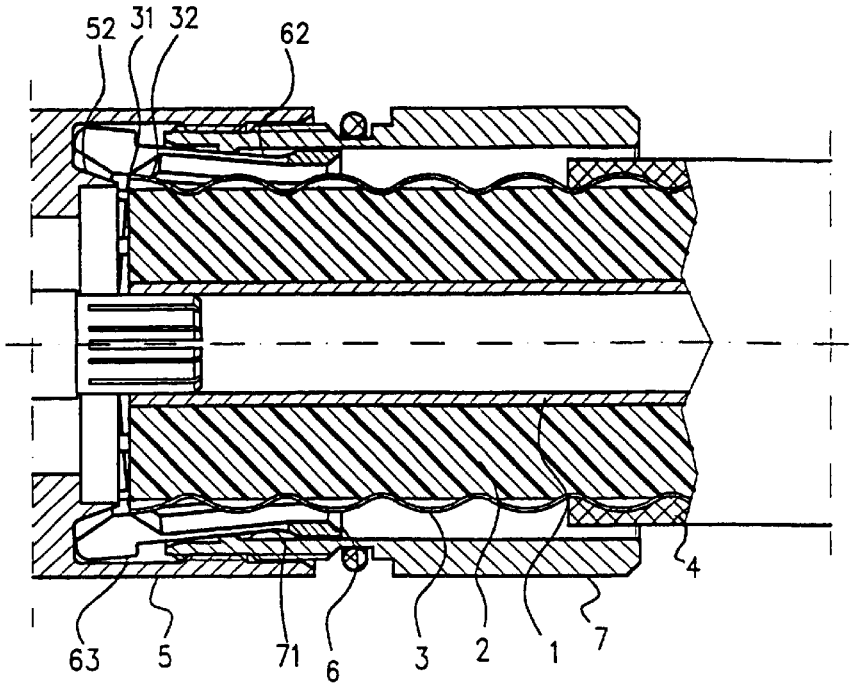
FIG. 3 is a sectional view of the connector of FIG. 1 during a first phase of attachment onto a cable end.

Throughout all the Figures, same or corresponding elements are generally indicated by same reference numerals.

Turning now to the drawing, and in particular to FIG. 1, there is shown a partially exploded sectional view of a first embodiment of a connector according to the present invention for attachment to a connecting end of a coaxial cable. In this context, reference is made to commonly assigned copending patent application, appl. Ser. No.: 09/145,677, entitled "Connector for a Coaxial Cable with Annularly Corrugated Outer Cable Conductor", the disclosure of which is incorporated herein by reference to show one type of connector involved here.

The connector includes a connector head 5 which is shown here only by way of its cable-proximal end that is of relevance as far as the present invention is concerned. The connector head 5 accommodates an inner conductor 4 held centrally in and spaced from the connector head 5 by an insulating plastic disk (not shown). On its cable-proximal end, the connector head 5 is formed with a recess 51 which is flanked by a beveled ring surface 52 and destined to accommodate a contact sleeve 6 which is configured in the form of a collet. The contact sleeve 6 has a plurality of axial slits 61 extending from the connector head proximal end to form a plurality of resilient segments 62. Each segment 62 has a free end terminating in a bead 63. On its opposite connector head distal end 64, the contact sleeve 6 has a slightly greater outer diameter than in the area of its resilient segments 62.

The contact sleeve 6 is inserted in a clamping bush in the form of a hollow screw 7 by pushing the resilient segments 62 together. In the assembly stage, shown in FIG. 1, the contact sleeve 6 is freely movable within the hollow screw 7 but held captive in the hollow screw 7, e.g. through provision of an inwardly projecting inner collar 71, located near the cable-proximal axial end of the hollow screw 7, which collar 71 interacts with a shoulder **6*a* of the beads 63 and an enlarged and substantially rigid bead-distant end 6*b* of the contact sleeve 6, so that the axial movement of the contact sleeve 6 in both directions is restricted. The resiliency of the segments 62 allows the contact sleeve 6 to glide under the inner collar 71 and thus a detachment thereof. The hollow screw 7 has an external thread which includes a first short threaded portion 72, positioned slightly inwardly of the axial end of the hollow screw 7 and comprised of only few threads, and a second long threaded portion 73, spaced inwardly of the first threaded portion 72, thereby demarcating therebetween a smooth portion 74 that is free from any threads. The long threaded portion 73 terminates in an annular circumferential groove for receiving an O-ring 75 which provides a seal between the connector head 5 and the hollow screw 7 and a seal of the recess 51 when the hollow screw 7 is rotated into the connector head 5**.

The inside of the axial end zone of the connector head 5 for receiving the hollow screw 7 is designed to complement the outer configuration of the hollow screw 7 and includes a smooth portion 53 extending inwardly of the axial end face and continued by an inner threaded portion 55 which has a length which is equal or smaller than the length of the smooth portion 74 of the hollow screw 7. The complementary configuration between the outside of the hollow screw 7 and the inside of the connector head 5 in the attachment area forms an indexing mechanism by which the attachment and thus the clamping path of the hollow screw 7 in the connector head 5 is subdivided into two sections, as will now be described.

Turning now to FIG. 2, there is shown a sectional view of the connector of FIG. 1 in a pre-assembled stage, with the hollow screw 7 rotated into the connector head 5 to such an extent that the inner threaded portion 55 of the connector head 5 lies fairly loosely in the smooth portion 74 of the hollow screw 7. This position of the hollow screw 7 relative to the connector head 5 marks the end of a first phase of the clamping path of the hollow screw 7 in the connector head 5 and thus the beginning of a second phase of the clamping path. This first phase of the clamping path of the hollow screw 7 in the connector head 5 represents the preassembled state of the connector, as supplied by a manufacturer, for attachment to a conventional coaxial cable with annularly corrugated outer cable conductor 3, shown in FIG. 3.

FIG. 3 shows a partial longitudinal section of the preassembled connector for attachment onto a suitably prepared connecting end of the coaxial cable, with the connector not yet occupying its fully assembled disposition. The coaxial cable includes an inner tubular cable conductor 1 which is centered inside the cable and spaced and insulated from the outer cable conductor 3 by a dielectric 2, with the outer surface of the outer cable conductor 3 being covered by a sheath 4. Persons skilled in the art will appreciate that the connection of the inner conductor does not form part of the present invention and thus has been omitted from the drawings for the sake of simplicity. The connector is placed over the connecting end of the coaxial cable whereby the end of the outer cable conductor 3 pushes the contact sleeve 6 into the illustrated position in which either the end faces of the beads 63 of the outwardly deflected resilient segments 62 of the contact sleeve 6 contact the bottom of the recess 51 of the connector head 5, as shown in FIG. 3, or the inner surfaces of the beads 63 at the end of the outwardly deflected resilient segments 62 contact the beveled ring surface 52 of the connector head 5.

Figure 4:
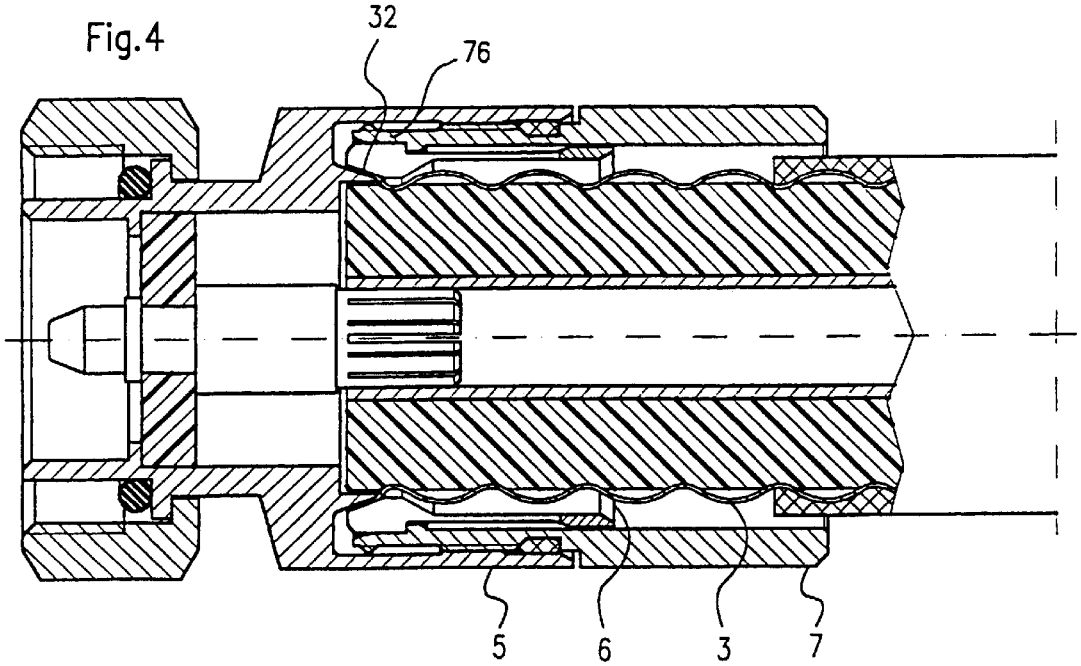
FIG. 4 is a sectional view of the connector of FIG. 1, illustrating the fully assembled connector.

As the connector is further advanced from the position shown in FIG. 3 over the cable end, the end zone 32 of the outer cable conductor 3 migrates between the ring surface 52 and the complementary confronting surface of the beads 63 of the resilient segments 62. While the connector head 5 is now held in place, the hollow screw 7 is further threaded into the connector head 5 to cover the second section of its clamping path until the end zone 32 of the outer cable conductor 3 is firmly clamped between the ring surface 52 and the beads 63 of the contact sleeve 6 to thereby effect a secure contacting, as shown in FIG. 4. This now represents the fully assembled stage of the connector. The axial end 76 of the hollow screw 7 prevents a radial deflection of the segments 62 of the contact sleeve 6 and the contact sleeve 6 is secured in axial direction as the inwardly projecting inner collar 71 of the hollow screw 7 bears upon the annular shoulders 6*a* of the beads 63.

Prior to attachment of the connector onto the coaxial cable, it may be suitable to install a separate sealing ring in a first valley on the exposed portion of the outer cable conductor 3, immediately following the sheath 4. Persons skilled in the art will understand, however, that sealing of the gap between the inner surface of the hollow screw 7 and the outer surface of the outer cable conductor 3 may also be effected by other means, e.g. through injection of an elastic sealant into the annular gap.

Figure 5:
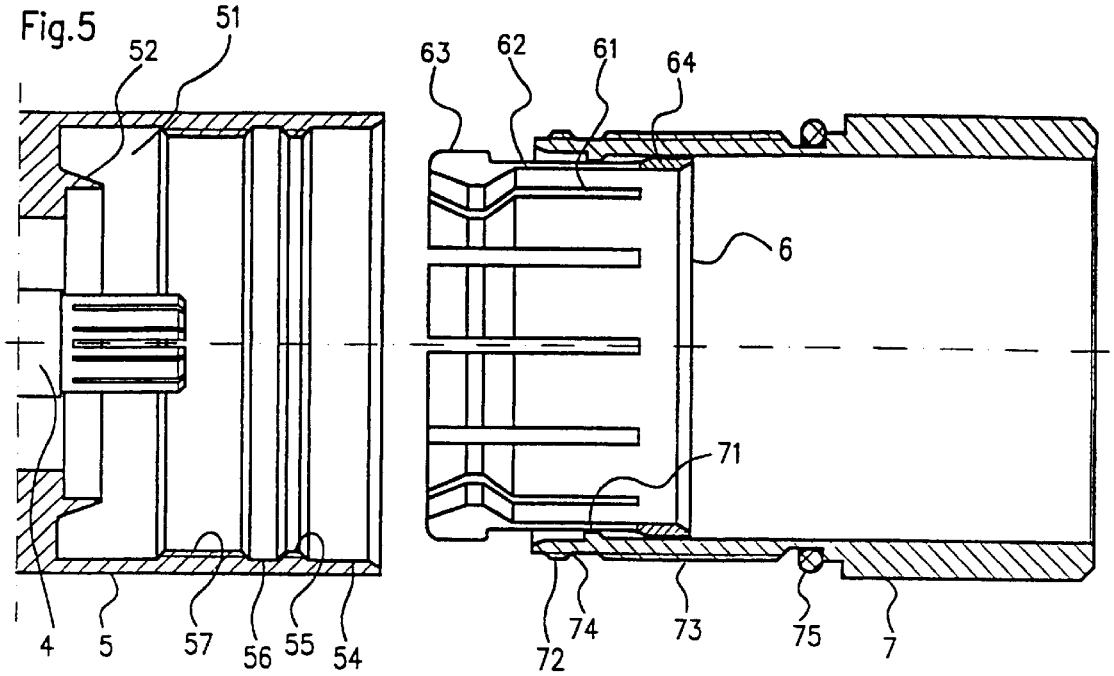
FIG. 5 is a partially exploded sectional view of a second embodiment of a connector according to the present invention, showing individual components of the connector before pre-assembly.

Turning now to FIG. 5, there is shown a partially exploded sectional view of a second embodiment of a connector according to the present invention. Parts corresponding with those in FIG. 1 are denoted by identical reference numerals and not explained again. In contrast to the embodiment of FIG. 1, the smooth portion 74 of the hollow screw 7 is of shorter configuration than the complementary threaded portion 55 of the connector head 5, whereby the axial length of the threaded portion 55 is equal or smaller than the length of the smooth portion 74 of the hollow screw 7. Provided inwardly of the threaded portion 55 is a smooth portion 56 defined by an axial length which is at least equal to the axial length of the first threaded portion 72 of the hollow screw 7. Following inwardly of the smooth portion 56, the connector head 5 has a second threaded portion 57.

Figure 6:
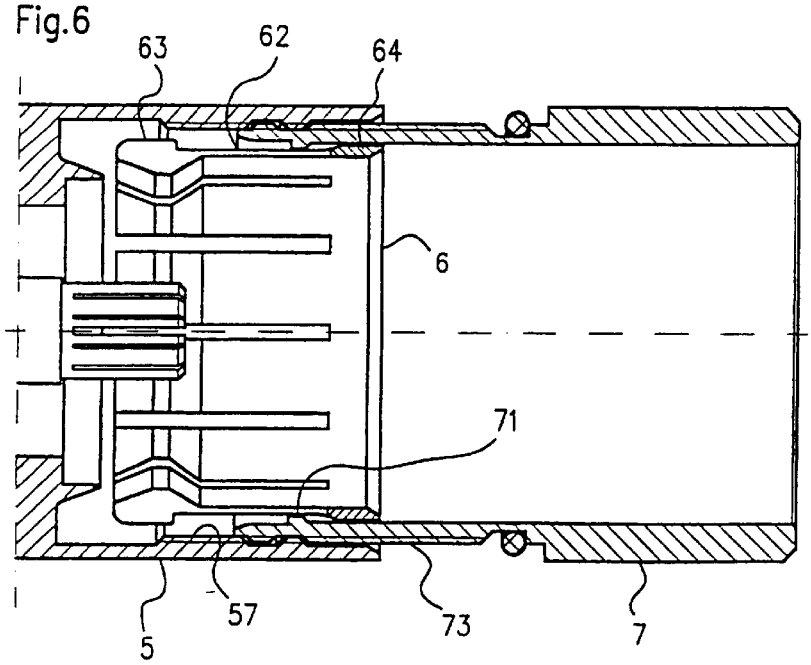
FIG. 6 is a sectional view of the connector of FIG. 5 in the pre-assembled stage.

FIG. 6 shows a sectional view of the connector of FIG. 5 in a pre-assembled stage, and it can be seen that the smooth portion 56 of the connector head 5 is in engagement with the first threaded portion 72 of the hollow screw 7, and the smooth portion 74 of the hollow screw 7 is in engagement with the first threaded portion of the connector head 5, thereby marking the first phase of the clamping path to effect attachment of the hollow screw 7 in the connector head 5.

Figure 7:
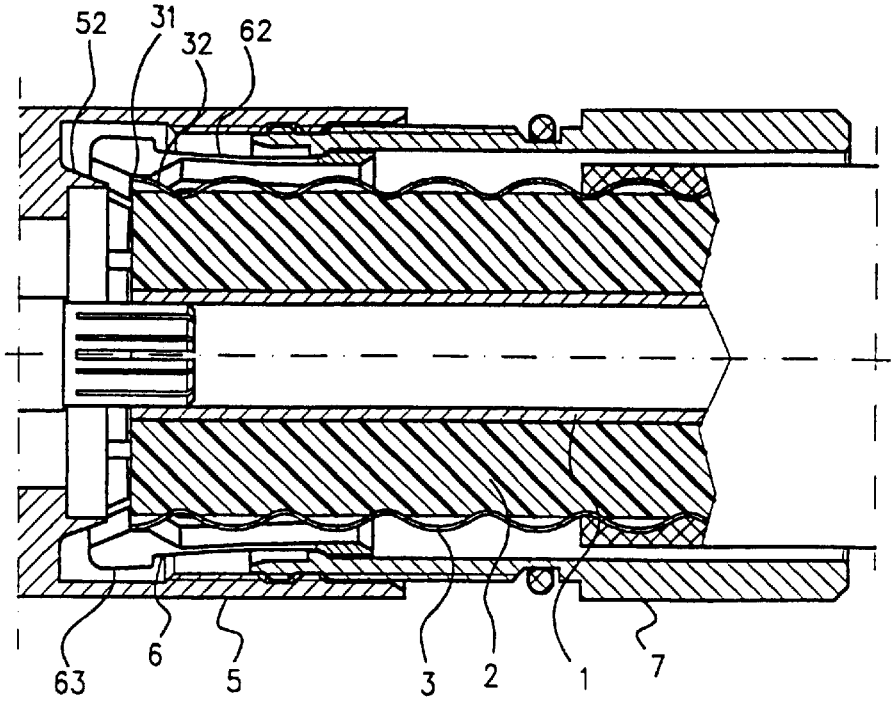
FIG. 7 is a sectional view of the connector of FIG. 5 during a first phase of attachment onto a cable end.
Figure 8:
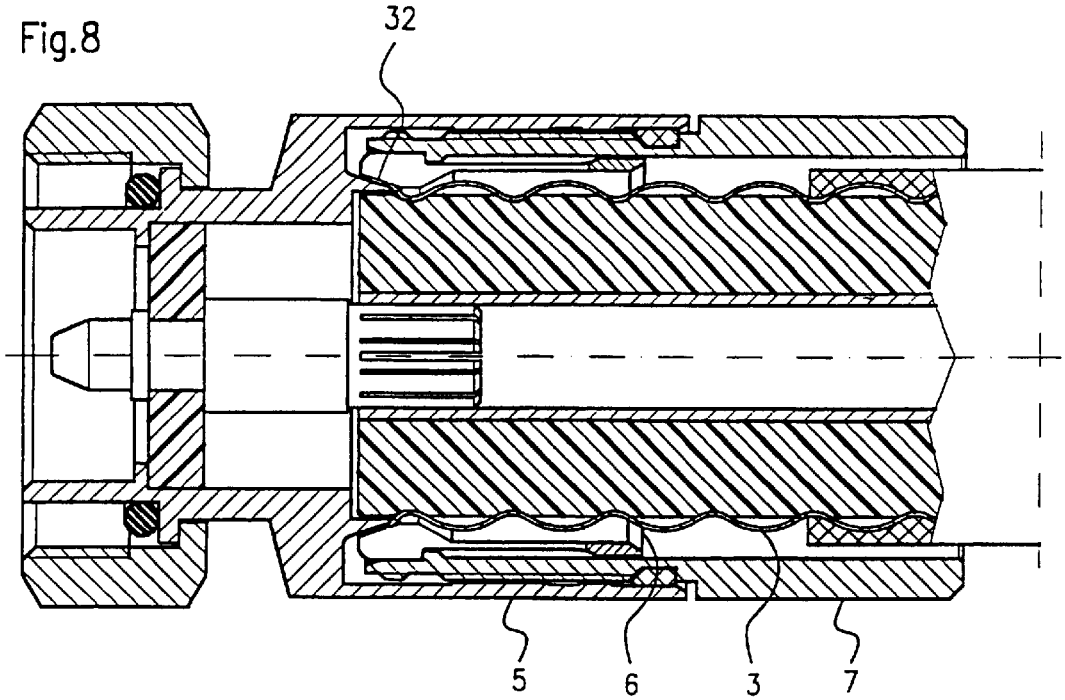
FIG. 8 is a sectional view of the connector of FIG. 5, illustrating the fully assembled connector.

FIGS. 7 and 8 show partial longitudinal sections of the connector for attachment onto the suitably prepared connecting end of the coaxial cable. The attachment is realized in a same manner as described with respect to FIGS. 3 and 4. The connector is placed over the prepared end of the coaxial cable such that the end of the outer cable conductor 3 pushes the contact sleeve 6 into the illustrated position in which either the end faces of the beads 63 of the outwardly deflected resilient segments 62 of the contact sleeve 6 contact the bottom of the recess 51 of the connector head 5, as shown in FIG. 7, or the inner surfaces of the beads 63 at the end of the outwardly deflected resilient segments 62 contact the beveled ring surface 52 of the connector head 5. As the connector is further advanced from the position shown in FIG. 7 over the cable end, the end zone 32 of the outer cable conductor 3 moves between the ring surface 52 and the complementary confronting surface of the beads 63 of the resilient segments 62. While the connector head 5 is now held in place, the hollow screw 7 is further rotated into the connector head 5 to cover the second section of its clamping path until the end zone 32 of the outer cable conductor 3 is firmly clamped between the ring surface 52 and the beads 63 of the contact sleeve 6 to thereby effect a secure contacting, as shown in FIG. 8. This now represents the fully assembled stage of the connector.

Figure 9:
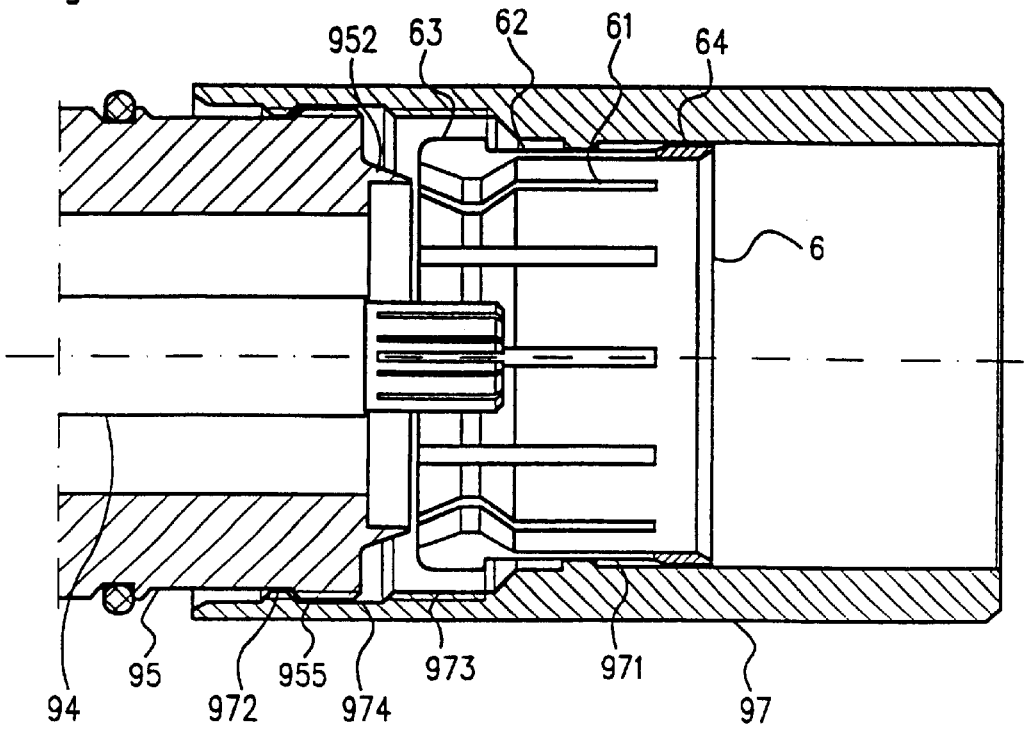
FIG. 9 is a partially exploded sectional view of a third embodiment of a connector according to the present invention, illustrating the connector in a pre-assembly stage.

Turning now to FIG. 9, there is shown a partially exploded sectional view of a third embodiment of a connector according to the present invention. The connector includes a connector head 95 which accommodates therein an inner conductor 94 and is formed with an outer threaded portion 955. Projecting out from one axial end of the connector head 95 is a beveled ring surface 952. While the contact sleeve 6 is identical with the configuration shown in FIG. 1, the clamping bush is now designed—instead as a hollow screw—in the form of a clamping ring 97 with inner thread. The contact sleeve 6 is captivated in the clamping ring 97 by means of an inwardly projecting collar 971 so as to limit the axial displacement of the contact sleeve 6. The inner thread of the clamping ring 97 is comprised of a first threaded portion 972 and a second threaded portion 973 which is inwardly spaced from the first threaded portion 972 so as to define therebetween a smooth portion 974. As shown in FIG. 9, the outer threaded portion 955 of the connector head 95 is shorter than the smooth portion 974 of the clamping ring 97. The illustration of FIG. 9 represents the preassembly stage of the connector in which the outer threaded portion 955 of the connector head 95 engages the smooth portion 974 of the clamping ring 97, thereby marking the first phase of the clamping path of the clamping ring 97 in the connector head 95.

Figure 10:
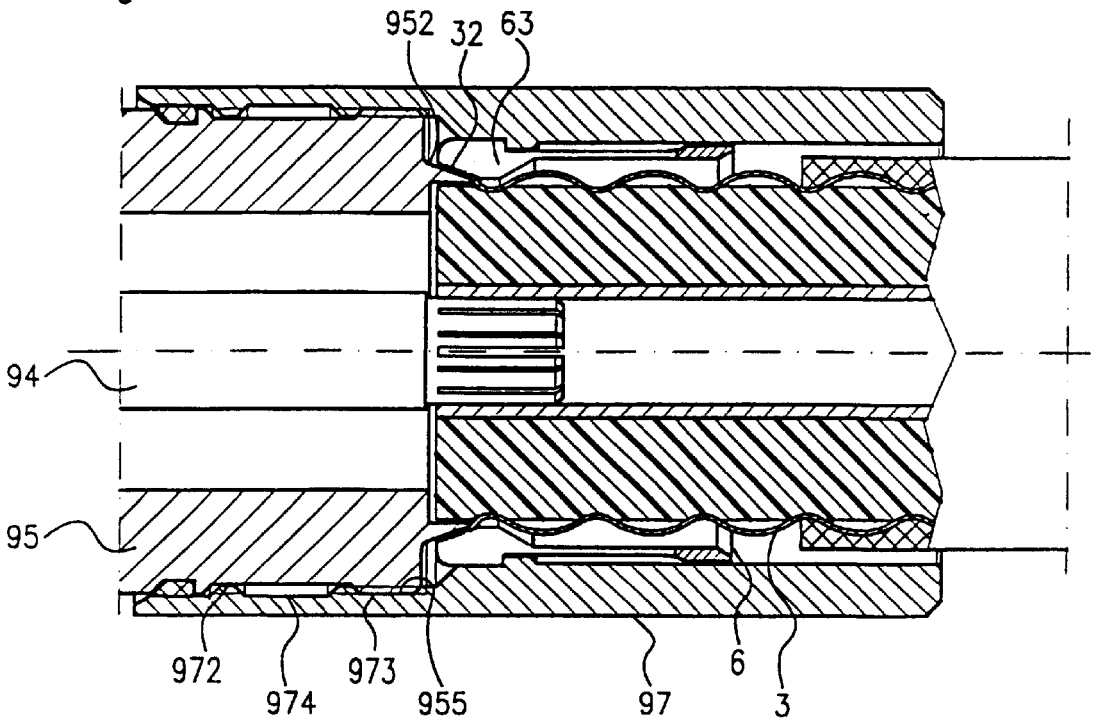
FIG. 10 is a sectional view of the connector of FIG. 9, illustrating the fully assembled connector.

FIG. 10 shows the fully assembled connector, with the second inner threaded portion 973 of the clamping ring 97 in mesh with the outer threaded portion 955 of the connector head 95. The end zone 32 of the outer cable conductor 3 is clamped between the ring surface 952 and the beads 63 at the end of the segments 62 of the contact sleeve 6 to thereby realize a secure contacting.

Figure 11:
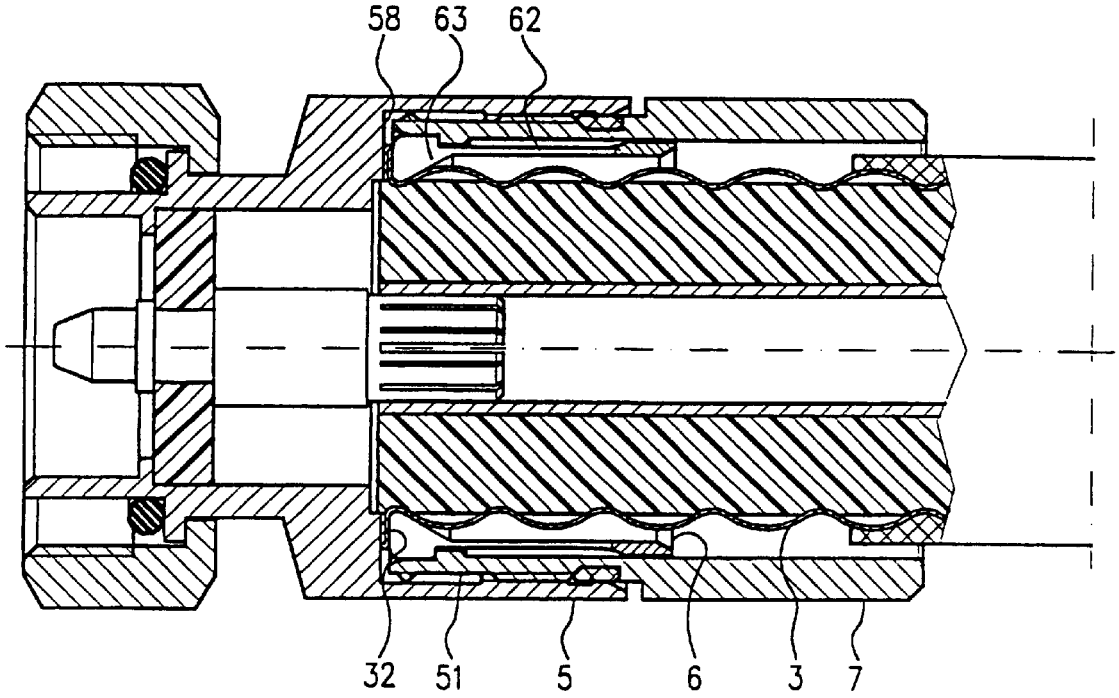
FIG. 11 is a partially exploded sectional view of a fourth embodiment of a connector according to the present invention, illustrating the fully assembled connector.

The embodiments described in FIGS. 1 to 10 embody the invention in connectors that are so designed that the end zone 32 of the outer cable conductor 3 is preferably cut in the area of a corrugation crest and is mechanically clamped and electrically contacted between the beveled ring surface of the connector head and the essentially complementary confronting surfaces of the beads 63 at the ends of the resilient segments 62 of the contact sleeve 6. Persons skilled in the art will understand, however, that the present invention should not be limited to such connectors because the concept of the present invention is equally applicable to connectors which realize the mechanical clamping and electric contacting of the cable and outer cable conductor in a different manner. An example is shown in FIG. 11 which depicts a partially exploded sectional view of a fourth embodiment of a fully assembled connector according to the present invention. This embodiment of the connector corresponds substantially to the embodiment of FIGS. 1 to 4, with the difference residing primarily in the type of clamping mechanism and type of contact-making mechanism. In this context, reference is made to German Pat. No. DE 43 44 328, published Jan. 12, 1995, which illustrates the type of clamping mechanism and type of contact-making mechanism, involved in the embodiment of FIG. 11. Parts corresponding with those in FIG. 1 are denoted by identical reference numerals and not explained again.

The end zone 32 of the outer cable conductor 3 is in contact in the recess 51 with the confronting end face of the connector head 5. In contrast to the embodiments shown in FIGS. 1 to 10, the recess 51 is not flanked by a beveled ring surface but is bounded by a bottom area 58 which extends substantially in a radial plane, with the flanged end zone 32 of the outer cable conductor 3 being clamped against the bottom area 58. The flanged end zone 33 is formed automatically during insertion of the hollow screw 7 along the second section of its clamping path in the recess 51 of the connector head 5 as a consequence of the configuration of the beads 63 at the ends of the resilient segment 62 of the contact sleeve, which beads 63 have end faces also oriented in a radial plane, so that in the preassembly stage of the connector, the beads 63 enter the first corrugation valley of the outer cable conductor 3. In the event, the initial end face of the outer cable conductor 3 is located in the area of a corrugation crest, as described in the previous embodiments, the end zone of the outer cable conductor is outwardly deflected in one layer in the form of a flange. If, however, the initial end face of the outer cable conductor is located in the area of a corrugation valley, a double-layer, flanged deformation of the end zone 32 of the outer cable conductor 3 is realized, as shown in FIG. 11 when turning the hollow screw 7 along the second section of the clamping path.

While the invention has been illustrated and described as embodied in a connector for a coaxial cable with annularly corrugated outer cable conductor, it is not intended to be limited to the details shown since various modifications and structural changes may be made without departing in any way from the spirit of the present invention.

What is claimed as new and desired to be protected by Letters Patent is set forth in the appended claims:

1. A connector for attachment to a coaxial cable having an annularly corrugated outer cable conductor, said connector comprising:

a connector head including a threaded portion and defining a ring surface for establishing a contact from inside with an end zone of an outer cable conductor;

a contact sleeve adapted to fit over the outer cable conductor and having a plurality of radially resilient segments;

a clamping bush adapted to fit over the contact sleeve and formed with a thread for threaded engagement with the connector head, said clamping bush, after moving a clamping path, loading the segments of the contact sleeve in a direction of a clamping action so that the segments clamp the end zone of the outer cable conductor, which end zone projects beyond an end face of the contact sleeve, against the ring surface of the connector head, said thread of the clamping bush interrupted along a longitudinal axis with a smooth portion; and indexing means for subdividing the clamping path of the clamping bush into first and second sections, with the first section corresponding to a preassembled state of the connector, and with the second section corresponding to a final assembly of the connector onto the cable end, said indexing means being formed by the smooth portion of the clamping bush and by the threaded portion of the connector head, said smooth portion and said threaded portion interacting with one another, substantially along the longitudinal axis with the threaded portion having a length which is equal or smaller than a length of the smooth portion of the clamping bush.

2. The connector of claim 1, wherein the clamping bush is a hollow screw formed with an outer thread, said threaded portion of the connector head being an inner thread formed in a recess of the connector head.

3. The connector of claim 2, wherein the connector head has an axial end for receiving the hollow screw, said connector head being formed with a ring collar, positioned between the threaded portion and the axial end for providing a guide when the hollow screw is threaded in.

4. The connector of claim 1 wherein the clamping bush is a clamping ring having an inner thread, said threaded portion of the connector head being an outer thread.

5. The connector of claim 1, wherein the thread of the clamping bush includes a first threaded portion, said connector head having an axial end for receiving the clamping bush, said connector head being formed with a smooth portion positioned axially inwardly of the threaded portion of the connector head and defined by a length which at least corresponds to a length of the first threaded portion of the clamping bush, said connector head including a further threaded portion positioned axially inwardly of the smooth portion.

6. The connector of claim 1, wherein the smooth portion of the clamping bush is a recess in the thread of the clamping bush and is of such dimension as to slightly exceed a depth of the thread.

7. The connector of claim 5, wherein the smooth portion of the connector head is a recess in the threaded portion of the connector head and is of such dimension as to slightly exceed a depth of the threaded portion.

8. The connector of claim 1, wherein the threaded portion of the connector head and the thread of the clamping bush are multiple threads.

* * * * *